US005749294A

United States Patent [19]

Ruf et al.

[11] Patent Number: 5,749,294

[45] Date of Patent: May 12, 1998

[54] DEVICE FOR CENTRALLY ADJUSTING SHEET-GUIDING ELEMENTS OF A SHEET-FED ROTARY PRINTING PRESS

[75] Inventors: Bernd Ruf, Weiterstadt; Kurt Lötsch, Wiesenbach, both of Germany

[73] Assignee: Heidelberger Druckmaschinen AG, Heidelberg, Germany

[21] Appl. No.: 753,365

[22] Filed: Nov. 25, 1996

[30] Foreign Application Priority Data

Nov. 24, 1995 [DE] Germany ..... 195 43 774.8

[51] Int. Cl.[6] ..... B41F 21/14

[52] U.S. Cl. ..... 101/232; 271/253; 271/248

[58] Field of Search ..... 101/232; 271/253, 271/255, 254, 248; 400/616.1, 633.2

[56] References Cited

U.S. PATENT DOCUMENTS

| | | | |
|---|---|---|---|
| 1,282,572 | 10/1918 | Hart | 400/633.2 |
| 2,273,565 | 2/1942 | Euth et al. | 400/633.2 |
| 3,578,138 | 5/1971 | Cantwell | 400/616.1 |
| 4,228,994 | 10/1980 | Volpe | 271/254 |
| 4,907,792 | 3/1990 | Washiashi et al. | 271/253 |
| 5,332,209 | 7/1994 | Romanksy et al. | 271/253 |
| 5,483,888 | 1/1996 | Greive | 101/232 |

FOREIGN PATENT DOCUMENTS

| | | |
|---|---|---|
| 0 305570 A1 | 3/1989 | European Pat. Off. . |
| 42 24 010 A1 | 2/1993 | Germany . |
| 43 27 012 A1 | 2/1995 | Germany . |

*Primary Examiner*—Edgar S. Burr
*Assistant Examiner*—Daniel J. Golilla
*Attorney, Agent, or Firm*—Herbert L. Lerner; Laurence A. Greenberg

[57] ABSTRACT

Printing press having a device for centrally adjusting sheet-guiding elements located both on the drive and the control or operating sides of the printing press, the adjusting device including adjusting members for respectively driving the sheet-guiding elements in common, includes a drive member couplable selectively to the respective adjusting member on a respective one of the drive and the operating sides and to the adjusting members on both the drive and the operating sides.

6 Claims, 5 Drawing Sheets

DEVICE FOR CENTRALLY ADJUSTING SHEET-GUIDING ELEMENTS OF A SHEET-FED ROTARY PRINTING PRESS

BACKGROUND OF THE INVENTION

FIELD OF THE INVENTION

The invention relates to a device for centrally adjusting sheet-guiding elements of a sheet-fed rotary printing press and, more particularly, sheet-guiding elements in the feeder and in the delivery of such a printing press. More specifically, the invention relates to a printing press having a device for centrally adjusting sheet-guiding elements located both on the drive and the control or operating sides of the printing press, the adjusting device including adjusting members for respectively driving the sheet-guiding elements in common.

In conventional printing presses, sheet-guiding elements for lateral sheet guiding are adjustable either individually or centrally in common in order to be able to adapt the sheet-guiding elements to the size or format of the sheet to be printed. Individual adjustment is regularly accomplished by control or adjusting members with a manually or motor-operated spindle, suitable markings being helpful in order to facilitate the correct adjustment. According to the state of the art, central adjustment systems are, in many cases, likewise operated manually by control or adjusting members which, for example, are coupled to one another on each of the two printing-press sides, i.e., the drive and the operating sides, by drive chains driven synchronously by hand or by electric motors. Heretofore known also are electrically motorized central-adjustment devices in which, possibly, electrically motorized individual drives, such as servomotors, particularly, are controlled by a control program for effecting the adjustment of the sheet-guiding elements. Such a central adjustment of the sheet-guiding elements, for example, when converting from one sheet size or format to another, is very elaborate and correspondingly expensive. Adjustments can be performed only by using prescribed programs, so that intermediate settings, for example, for the off-center printing of sheets, are achievable only in a relatively complicated manner or are barely possible.

SUMMARY OF THE INVENTION

It is accordingly an object of the invention to provide a printing press with a device for centrally adjusting the sheet-guiding elements, preferably in the feeder and in the delivery of a sheet-fed rotary printing press, with a device for mutually independently adjusting the sheet-guiding elements on the drive side and on the control or operating side of the printing press.

With the foregoing and other objects in view, there is provided, in accordance with one aspect of the invention, a printing press having a device for centrally adjusting sheet-guiding elements located both on the drive and the control or operating sides of the printing press, the adjusting device including adjusting members for respectively driving the sheet-guiding elements in common, including a drive member couplable selectively to the respective adjusting member on a respective one of the drive and the operating sides and to the adjusting members on both the drive and the operating sides.

In accordance with another feature of the invention, the drive member is couplable selectively to a first sprocket wheel, to a second sprocket wheel, and to both the first and the second sprocket wheels simultaneously, the first sprocket wheel engaging, on the drive side of the printing press, with a chain for driving the adjusting members of the sheet-guiding elements on the drive side of the printing press, and the second sprocket wheel engaging, on the operating side of the printing press, with a chain for driving the adjusting members of the sheet-guiding elements on the operating side of the printing press.

In accordance with a further feature of the invention, the drive member comprises a crankshaft, and a respective engageable and disengageable clutch is disposed between the crankshaft and the first and the second sprocket wheels.

In accordance with an added feature of the invention, the clutch includes first gearwheels, respectively, connected to each of the first and the second sprocket wheels so as to be fixed against rotation relative thereto, and respective second gearwheels disposed on the crankshaft so as to be fixed against rotation relative thereto, the teeth of each of the second gearwheels being meshable with the teeth of at least one of the first gearwheels.

In accordance with an additional feature of the invention, the clutch is formed of respective pairs of bevel gears, one bevel gear of each of the respective pairs of bevel gears being disposed on the crankshaft so as to be axially displaceable in the direction of the rotational axis thereof.

In accordance with yet another feature of the invention, the axially displaceable bevel gears of the pairs of bevel gears are disposed on a common rotational axis so as to be fixed against rotation relative thereto and are spring-loaded towards one another, and the rotational axes of the bevel gears coupled to one of the sprocket wheels are offset from one another, with identically directed rotational axes thereof, by the extent of the axial displaceability of the axially displaceable bevel gears.

In accordance with a concomitant aspect of the invention, there is provided a printing press having a device for centrally adjusting sheet-guiding elements located both on the drive and the control or operating sides of the printing press, the adjusting device including adjusting members for respectively driving the sheet-guiding elements in common, including a drive member for the adjusting members having a rotatable shaft axially displaceable into three settings wherein the drive member is selectively couplable with an adjusting member on the drive side of the printing press, with an adjusting member on the operating side of the printing press, and with both of the adjusting members on both the drive side and the operating side of the printing press.

With these structural features, a greater degree of flexibility in the adjustment of the sheet-guiding elements and in the adaptation thereof to a specific printing job is achieved. In particular, the adjustment of the sheet-guiding elements for printing operations which are not aligned to the center-line of the sheets is facilitated. Off-center printing operations can thus be performed more easily.

Frequently, the adjusting members of the sheet-guiding elements on each side of the printing press are connected to one another by a revolving chain. In such cases, in order to achieve an economical construction, a proposal is made that, on each side of the printing press, a sprocket wheel be provided which engages with the drive chain for the adjusting members of the sheet-guiding elements, the sprocket wheels being couplable either individually or jointly simultaneously to a drive member. The drive member preferably includes a manually or motor-rotatable shaft which is couplable to the two sprocket wheels by an engageable and disengageable clutch. The clutch may be formed of a respective first gearwheel connected to one of the two sprocket wheels so as to be fixed against rotation relative thereto, and a respective second gearwheel disposed on the drive shaft so as to be fixed against rotation relative thereto, the teeth of the respective second gearwheel being meshable either with the teeth of one of the respective first gearwheels or of both of the respective first gearwheels. In another preferred embodiment, the clutch includes a bevel-gear pairs, a bevel gear of one of the pairs being axially displaceable in the direction of the rotational axis thereof. The axially displaceable bevel gears of both bevel-gear pairs are disposed, so as to be fixed against rotation relative thereto, coaxially with respect to one another and are spring-loaded towards one another, the rotational axes of the bevel gears, which are coupled to one of the two sprocket wheels so as to be fixed against rotation relative thereto, being offset, with the identically directed rotational axes thereof, relative to one another by the extent of the axial displaceability of the axially displaceable bevel gears. This results in mechanically simple and consequently cost-effective, robust or strong adjusting devices which permit either the central adjustment of all sheet-guiding elements or only the adjustment of the sheet-guiding elements on either side of the printing press, so that the sheet-guiding elements on both sides of the printing press are adjustable independently of one another with respect to the centerline of the printing press.

Other features which are considered as characteristic for the invention are set forth in the appended claims.

Although the invention is illustrated and described herein as embodied in a device for centrally adjusting sheet-guiding elements of a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein;

DESCRIPTION OF THE PREFERRED EMBODIMENTS

Figure 1:
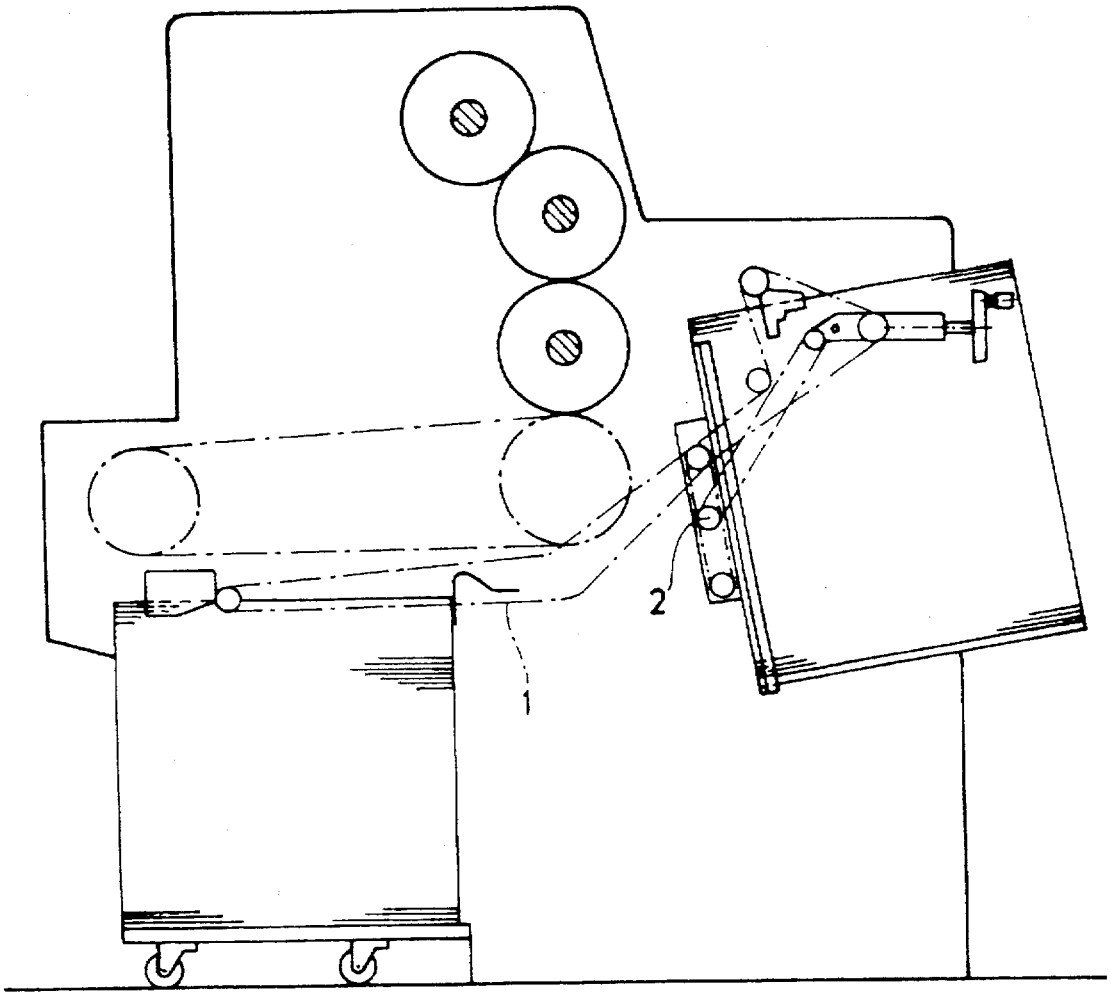
FIG. 1 is a diagrammatic side elevational view of a sheet-fed rotary printing press having adjusting members for sheet-guiding elements, the adjusting members being shown coupled to one another by a drive chain on one side of the printing press.

Referring now to the drawings and, first, particularly to FIG. 1 thereof, it is noted that, on each of the two printing-press sides in front of and behind the plane of the figure, namely, the drive side and the control or operating side thereof, adjusting members for sheet-guiding elements are coupled to one another by an endlessly revolving drive chain 1 or, where applicable, by a plurality of revolving drive chains. The drive chain or chains 1 of both printing-press sides are couplable to one another by a transversely extending shaft 2, due to which the synchronous movement of the drive chains 1 on each of the two printing-press sides is possible for effecting an in-common or joint adjustment of the sheet-guiding elements, which have otherwise not been represented in the drawing in the interest of clarity.

Figure 2:
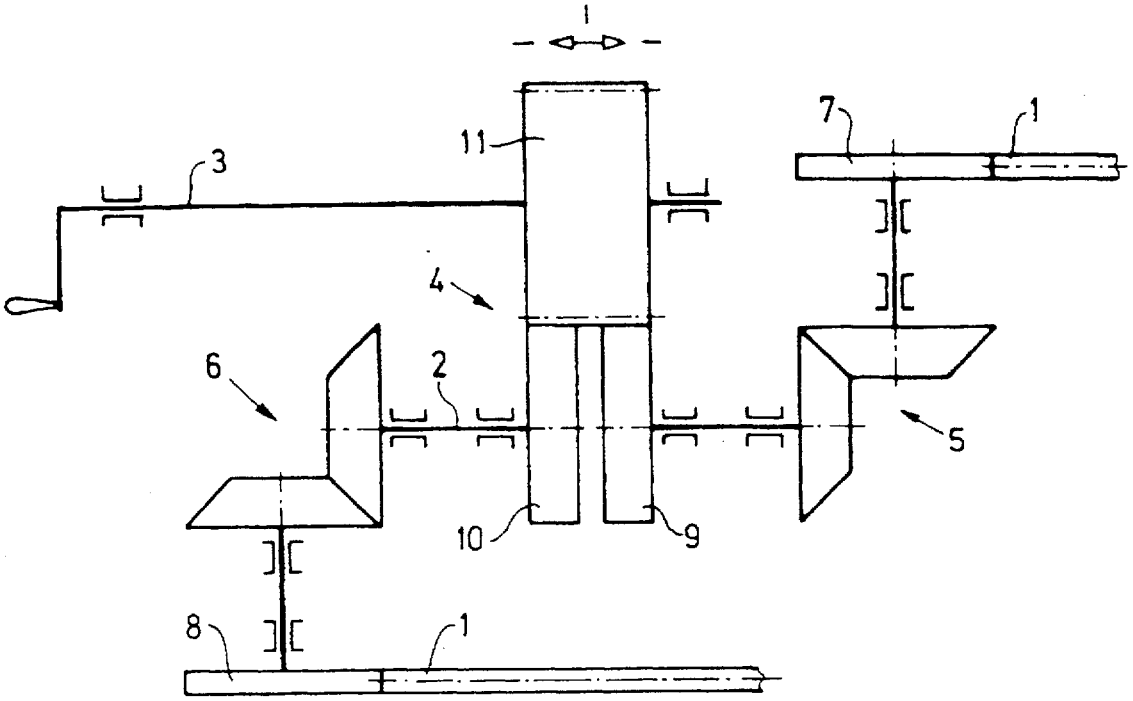
FIG. 2 is a diagrammatic view of a first embodiment of a device for coupling two drive chains, respectively, on the drive side and on the control or operating side of the printing press to a drive member.

The embodiment of the device for effecting either in-common or individual adjustment of the sheet-guiding elements on both sides of the printing press in FIG. 2 is constructed for manual operation. A drive member with a manually rotatable adjusting shaft 3 is couplable, through the intermediary of a spur-gear drive 4 and bevel-gear drives 5 and 6, either to one of the two drive chains 1 on each of the two sides of the printing press or to both drive chains 1, simultaneously. One of the bevel gears of each of the two bevel-gear drives 5 and 6 is connected, through the intermediary of a shaft, directly to one of two sprocket wheels 7 and 8, respectively, which engages with the drive chain 1. The other bevel gear of each of the two bevel-gear drives is connected directly to one of two spur gears 9 and 10, respectively, which are both supported independently of but coaxially with one another, the teeth thereof engaging or meshing with the teeth of a driving gearwheel 11, which is displaceable in the direction of the rotational axis thereof so that, through the axial displacement of the gearwheel 11, it is possible for the teeth to engage or mesh with either just one of the two spur gears 9 and 10 or both spur gears 9 and 10. It is consequently possible to couple the crankshaft 3 either to only one drive chain on one of the two sides of the printing press or to both drive chains simultaneously, so as to be fixed against rotation relative thereto, in order to perform adjustments to the sheet-guiding elements either only on one side of the printing press or simultaneously on both sides thereof.

Figure 3:
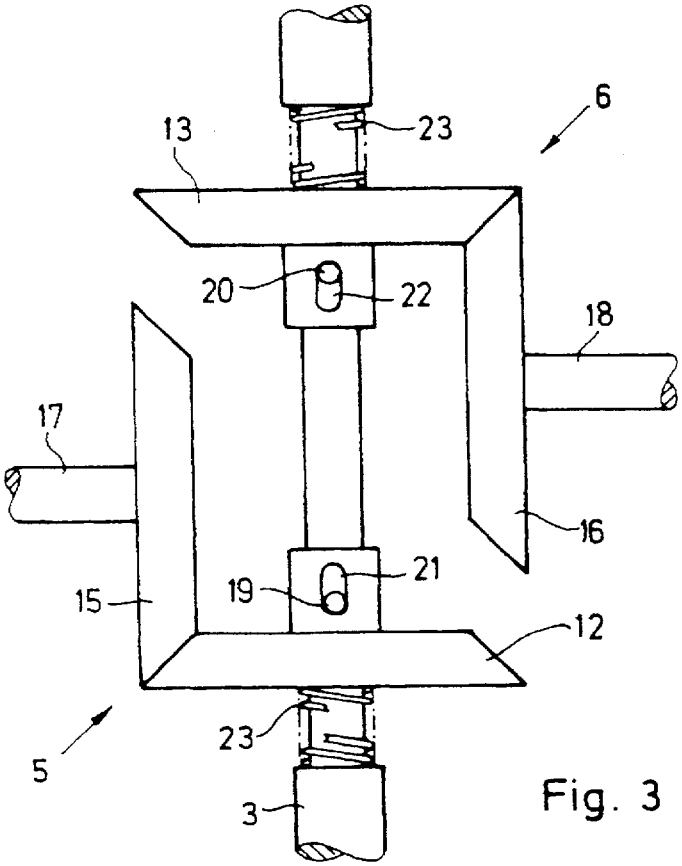
FIG. 3 is a diagrammatic view similar to that of FIG. 2, although somewhat enlarged, of a second embodiment of a device for coupling the two drive chains, respectively, on the drive side and on the control or operating side of the printing press to a drive member which is coupled to both of the drive chains.
Figure 4:
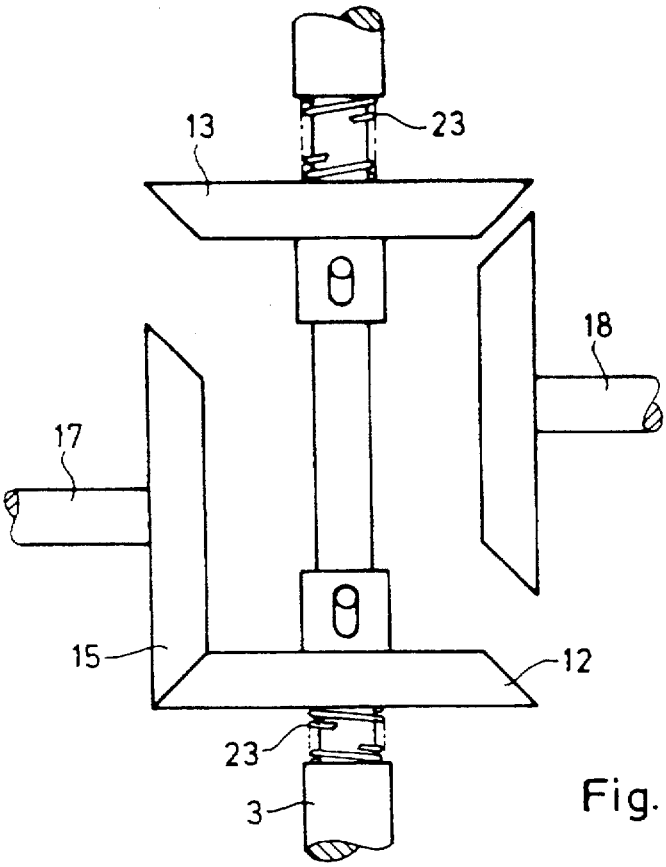
FIGS. 4 and 5 are diagrammatic views of FIG. 3 in different operating phases of the coupling device wherein, in FIG. 4, only one of the two drive chains for the adjusting members of the sheet-guiding elements is in coupled position and, in FIG. 5, only the other of the two drive chains is in coupled position.
Figure 5:
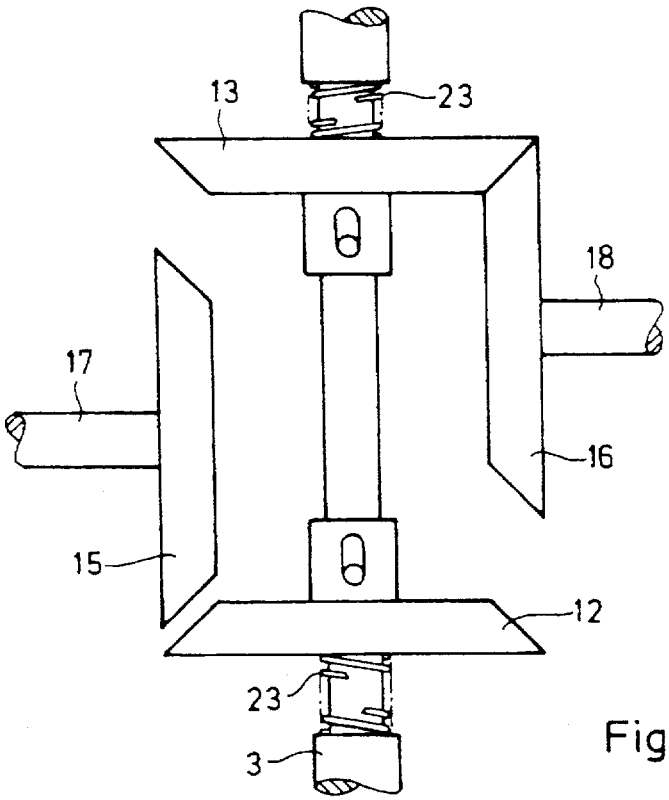

In another embodiment shown in FIGS. 3, 4 and 5, the manually or motor-operated crankshaft 3 passes through, so as to be fixed against rotation relative thereto, one bevel gear 12, 13 of each of the two bevel-gear pairs 5 and 6, the other bevel gears 15 and 16 of the two bevel-gear pairs 5 and 6 being disposed on locally-fixed supported output shafts 17 and 18, which are coupled to the sprocket wheels 8 and 7 engaging with drive chains 1 on the drive side and on the operating or control side of the printing press. The bevel gears 12 and 13 of both bevel-gear pairs 5 and 6 are disposed axially displaceably on the crankshaft 3 yet fixed against rotation relative thereto. The axial displaceability is limited by stops, for example, by a fixed pin 19, 20 of the crankshaft 3, the pins 19 and 20, respectively, engaging in respective axial slots 21 and 22. Both gearwheels 12 and 13 are axially spring-loaded in the direction of engagement thereof by the teeth thereof with the appertaining bevel gears 15 and 16, respectively. Helical springs 23 are shown arranged in FIGS. 3 to 5 to permit the crankshaft 3, as shown in FIG. 3, to be coupled to each of the two output shafts 17 and 18, in order to be able to perform adjustments synchronously on both sides of the printing press. Through axial displacement of the crankshaft 3 it is also possible, however, to couple the crankshaft 3 selectively to either of the two output shafts 17 and 18, respectively, as shown in FIGS. 4 and 5, respectively.

Figure 6:
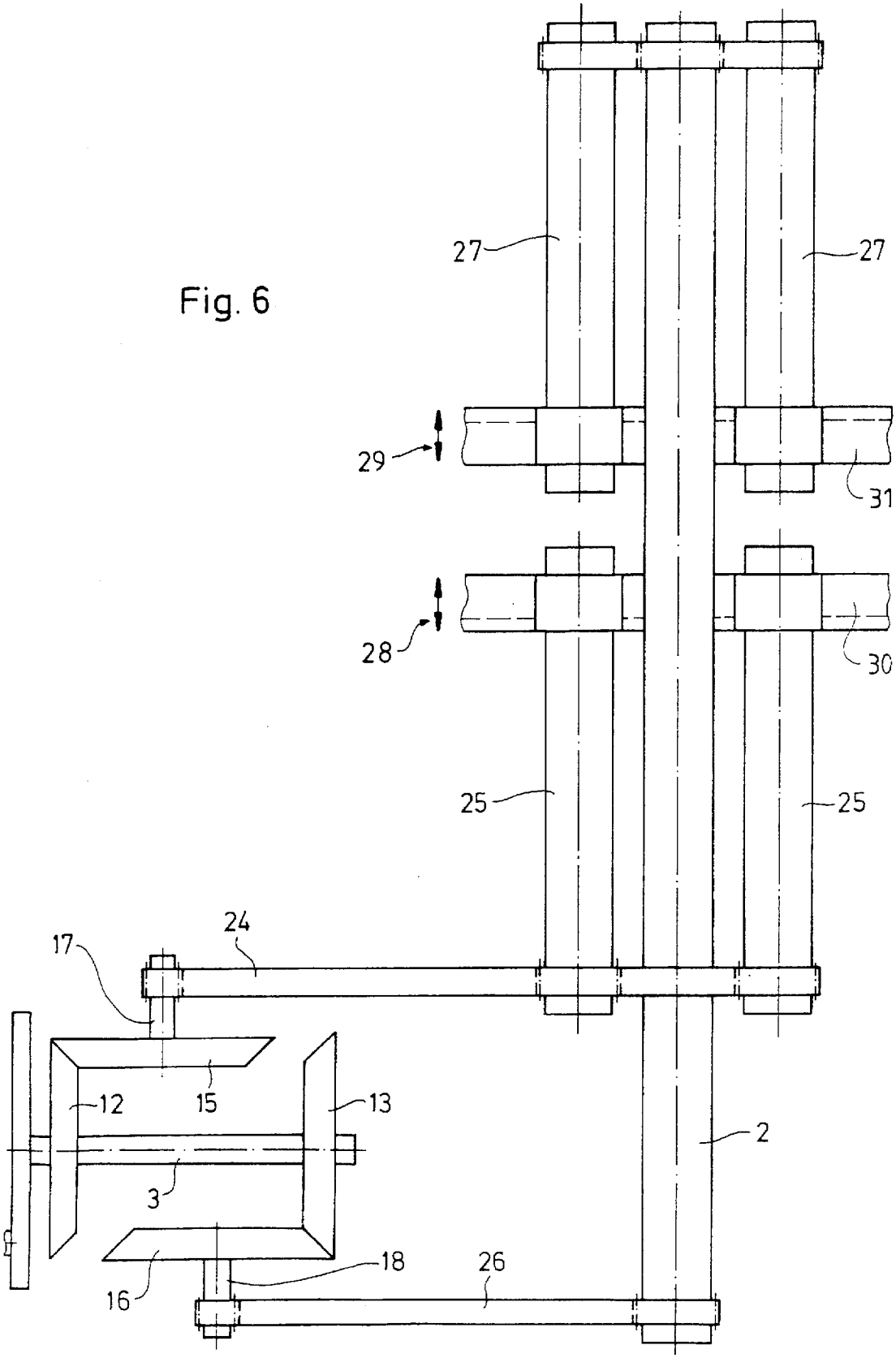
FIG. 6 is a diagrammatic top plan view of transmission members for effecting the adjusting movements on both sides of the printing press, the coupling device of FIG. 3 being shown therein at the bottom left-hand side thereof in somewhat reduced size and rotated 90° clockwise.
Figure 7:
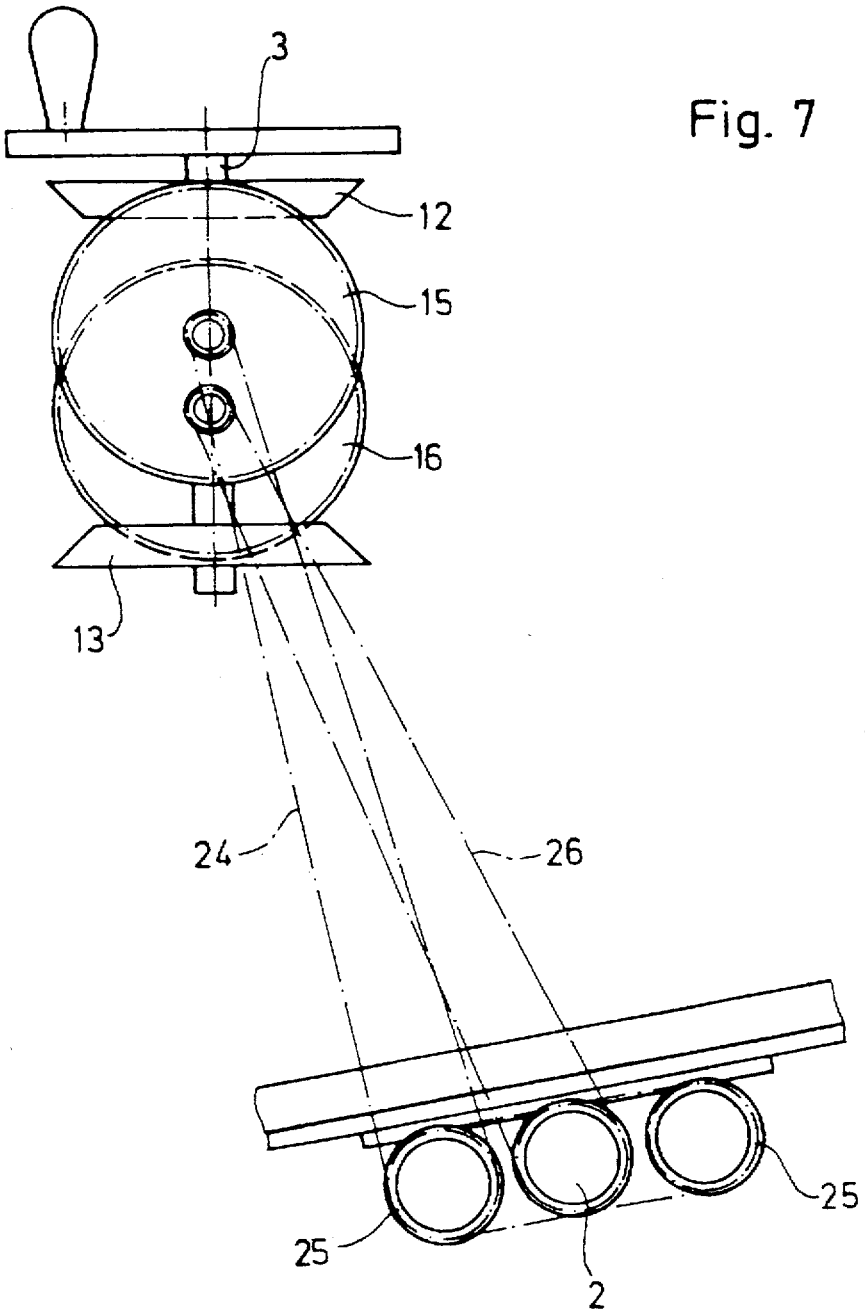
FIG. 7 is a side elevational view of FIG. 6 as seen from the bottom thereof.

In the embodiment shown in FIGS. 6 and 7, one gearwheel 15 held in a fixed mounting support in the printing press is connected through the intermediary of th e output shaft 17 by a chain drive 24 to adjusting members 25 on one side of the printing press, while the other gearwheel 16 held in a fixed mounting support in the printing press is connected through the intermediary of a chain drive 26 to the transversely extending shaft 2 which, in turn, operates or actuates adjusting members 27 disposed on the other side of the printing press. Instead of the illustrated chain drives 24 and 26, it is also possible to employ belt drives or gearwheel connections between the output shafts 17 and the adjusting members 25, on the one hand, as well as the output shaft 18 and the transversely extending shaft 2. The adjusting members 25 and 27, respectively, are formed, for example, with spindle threads which threadedly engage in and penetrate threaded nuts of the printing-press elements 30 and 31 which are to be adjusted, in order thereby to effect adjusting movements of the elements 30 and 31 in the direction of the double-headed arrows 28 and 29 transversely to the longitudinal direction of the printing press. The coupling of the two bevel gears 15 and 16, for effecting the synchronous adjustment of elements for sheet alignment and sheet guidance on both sides of the printing press, is accomplished, for example, in the manner shown in FIG. 3 and described hereinbefore.

We claim:

1. Printing press having a device for centrally adjusting sheet-guiding elements located on both sides of the printing press, the adjusting device comprising a drive member including a rotatable shaft axially displaceable into three settings whereby said drive member is selectively couplable with an adjusting member on one side of the printing press, with an adjusting member on an other side of the printing press, or simultaneously with both of the adjusting members on both sides of the printing press.

2. Printing press according to claim 1, which further comprises a first sprocket wheel, a second sprocket wheel, a chain on the one side of the printing press for driving the adjusting members of the printing press and a chain on the other side of the printing press for driving the adjusting members of the printing press, said drive member being couplable selectively to said first sprocket wheel, to second sprocket wheel, and to both said first and said second sprocket wheels simultaneously, said first sprocket wheel engaging, on the one side of the printing press, with said chain for driving the adjusting members of the sheet-guiding elements on the one side of the printing press, and said second sprocket wheel engaging, on the other side of the printing press, with said chain for driving the adjusting members of the sheet-guiding elements on the other side of the printing press.

3. Printing press according to claim 2, wherein said drive member comprises a crankshaft, and a respective engageable and disengageable clutch is disposed between said crankshaft and said first and said second sprocket wheels.

4. Printing press according to claim 3, wherein said clutch includes first gearwheels, respectively, connected to each of said first and said second sprocket wheels so as to be fixed against rotation relative thereto, and respective second gearwheels disposed on said crankshaft so as to be fixed against rotation relative thereto, the teeth of each of said second gearwheels being meshable with the teeth of at least one of said first gearwheels.

5. Printing press according to claim 3, wherein said clutch is formed of pairs of bevel gears, one bevel gear of each of the pairs of bevel gears being disposed on said crankshaft so as to be axially displaceable in the direction of the rotational axis thereof.

6. Printing press according to claim 5, wherein said axially displaceable bevel gears of said pairs of bevel gears are disposed on a common rotational axis so as to be fixed against rotation relative thereto and are spring-loaded towards one another, and wherein said rotational axes of said bevel gears coupled to one of said sprocket wheels are offset from one another, with identically directed rotational axes thereof, by the extent of the axial displaceability of said axially displaceable bevel gears.

* * * * *